US009347300B2

(12) United States Patent
Anter

(10) Patent No.: US 9,347,300 B2
(45) Date of Patent: May 24, 2016

(54) METHOD AND THERMAL-ELECTRICAL GENERATING APPARATUS TO TRANSPORT SUBTERRANEAN OIL TO THE SURFACE

(71) Applicant: Michael D Anter, Glendale, AZ (US)

(72) Inventor: Michael D Anter, Glendale, AZ (US)

( * ) Notice: Subject to any disclaimer, the term of this patent is extended or adjusted under 35 U.S.C. 154(b) by 0 days.

(21) Appl. No.: 14/544,399

(22) Filed: Dec. 31, 2014

(65) Prior Publication Data

US 2015/0322752 A1 Nov. 12, 2015

Related U.S. Application Data

(63) Continuation-in-part of application No. 13/506,127, filed on Mar. 29, 2012, now Pat. No. 8,931,564, which is a continuation-in-part of application No. 12/584,179, filed on Aug. 31, 2009, now Pat. No. 8,251,149.

(51) Int. Cl.

| | |
|---|---|
| ***E21B 17/22*** | (2006.01) |
| ***F04D 13/10*** | (2006.01) |
| ***E21B 43/12*** | (2006.01) |
| ***E21B 43/24*** | (2006.01) |

(52) U.S. Cl.

CPC ..... *E21B 43/121* (2013.01); *E21B 43/126* (2013.01); *E21B 43/24* (2013.01)

(58) Field of Classification Search

CPC ... E21B 43/128; E21B 43/121; E21B 43/126; E21B 43/129; E21B 17/22; E21B 43/127; F04C 11/001; F04C 13/008; F04C 18/16; F04D 13/10; F04D 13/12; F04D 3/02

See application file for complete search history.

(56) References Cited

U.S. PATENT DOCUMENTS

| | | | | |
|---|---|---|---|---|
| 4,661,046 | A * | 4/1987 | Ruyle | 417/203 |
| 4,819,348 | A * | 4/1989 | DeBolt | 37/350 |
| 4,971,526 | A * | 11/1990 | Ruyle | 417/244 |
| 5,174,725 | A * | 12/1992 | Guile et al. | 417/205 |
| 6,170,667 | B1 * | 1/2001 | Bilak et al. | 209/3 |
| 6,406,277 | B1 * | 6/2002 | Shafer et al. | 417/424.2 |
| 6,439,311 | B2 * | 8/2002 | Haseloh | 166/311 |
| 7,461,692 | B1 * | 12/2008 | Wang | 166/105.5 |
| 8,007,254 | B2 * | 8/2011 | LaRose et al. | 417/356 |
| 8,251,149 | B2 * | 8/2012 | Anter | 166/369 |
| 8,931,564 | B2 * | 1/2015 | Anter | 166/369 |

* cited by examiner

*Primary Examiner* — Shane Bomar
*Assistant Examiner* — Kipp Wallace
(74) *Attorney, Agent, or Firm* — Tod R. Nissle, P.C.

(57) ABSTRACT

A method to extract oil for a pool of oil in the ground utilizes an interconnected series of rotating helical blades extending from the surface of the ground through a canted bore to the pool of oil. The blades can be staggered and interconnected with a gear arrangement that moves oil from pool to pool and up to the surface of the ground.

2 Claims, 8 Drawing Sheets

METHOD AND THERMAL-ELECTRICAL GENERATING APPARATUS TO TRANSPORT SUBTERRANEAN OIL TO THE SURFACE

This is a continuation-in-part of application Ser. No. 13/506,127, filed Mar. 29, 2012, which is a continuation-in-part of application Ser. No. 12/584,179, filed Aug. 31, 2009.

This invention relates to systems for extracting subterranean oil.

More particularly, the invention relates to an improved system to move oil from a subterranean pool upwardly through a slanted bore to the surface of the ground.

A long existing motivation in connection with removing petroleum reserves from the ground comprises developing new systems and technologies to maximize the quantity of oil which can be removed from an oil field.

Accordingly, it would be highly desirable to provide an improved process for extracting oil from the ground.

Therefore it is a principal object of the invention to provide an improved oil extraction method and apparatus.

This and other, further and more specific objects of the invention will be apparent to those skilled in the art from the following detailed description thereof, taken in conjunction with the drawings, in which.

Figure 1:
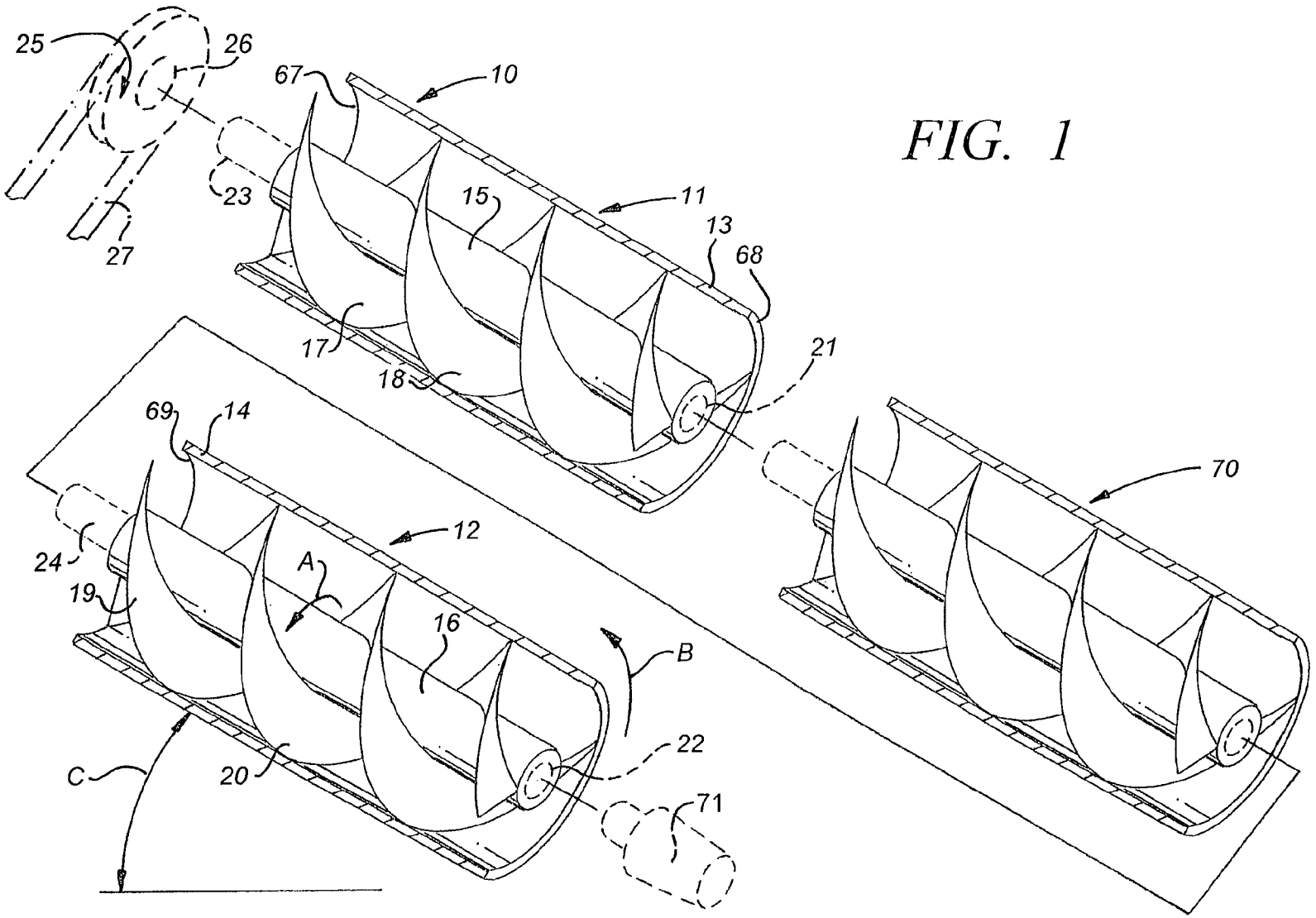
FIG. 1 is a perspective exploded assembly section view illustrating an oil extraction apparatus constructed in accordance with the invention.

Briefly, in accordance with the invention, I provide an improved method to extract oil from a pool of oil in the ground. The method includes the step of providing an oil extraction apparatus. The extraction apparatus includes an elongate housing; at least one baffle wall (51) fixedly secured to said housing to pool oil during the operation of said oil extraction apparatus; and, a plurality of staggered, interconnected, rotatable units (42A, 42D). Each unit 42A, 42D includes a hollow cylindrical conduit having a first end and a second end; a first gear mounted on the first end; a second gear mounted on the second end; a drive shaft extending through the conduit; and, at least one helical blade attached to and extending about the drive shaft. The first gear (46) on a first one of the units (42A) engages the second gear (45) on a second one of the units (42D). The second one of the units is staggered from said first one of the units such that when the first one of the units rotates, the first gear rotates the second gear and the second unit. The first end of the first one of the units (42A) rotatably extends through the baffle wall (51).

The second end of the second one of the units (42D) is adjacent the baffle wall. The extraction apparatus also includes motive power to rotate the units (42A, 42D). The method includes the additional steps of boring an elongate canted opening in the ground at a selected angle from the horizontal; inserting the oil extraction apparatus in the bore such that a portion of the first one of the units is submerged in the pool of oil; and, operating said motive power to rotate said units (42A, 42D) such that oil from the pool travels up the first one of the units and pools adjacent the baffle wall (51), and oil pooling adjacent said baffle wall travels up the second one of the rotating units.

In another embodiment of the invention, I provide an improved method to extract oil from a pool of oil in the ground. The method includes the step of providing an oil extraction apparatus. The apparatus comprises an elongate housing; a plurality of interconnected, rotatable units (11, 12) each including a hollow cylindrical conduit having a first end, a second end, a drive shaft extending through the conduit, and at least one helical blade attached to and extending about the drive shaft; and, motive power to rotate the units (11, 12). The method also includes the steps of boring an elongate canted opening in the ground at a selected angle from the ground; inserting the oil extraction apparatus in the bore such that a portion of the first one of the units is submerged in the pool of oil; and, operating the motive power to rotate the units (11, 12) such that the helical blades carry oil upwardly from the pool. The oil extraction apparatus is not utilized to bore the elongate canted opening in the ground.

In a further embodiment of the invention, I provide an improved method to extract oil from the ground. The method comprises the step of providing an oil extraction apparatus comprising an elongate tubular assembly. The assembly comprises a plurality of sequential interconnected units. Each unit includes a hollow cylindrical conduit having a first end and a second end; a first gear mounted at the first end; a second gear mounted at the second end; a drive shaft connected to the first and second gears and extending through the conduit and intermediate the first and second gears; and, at least one helical blade attached to and extending about the drive shaft. The first gear on a first one of the sequential units engages the second gear on a second one of the units adjacent to the first one of the units to interconnect the first and second units such that when the drive shaft in the first one of the units rotates, the drive shaft in the first one of the units rotates simultaneously with the drive shaft in the second one of the units, and when the first gear rotates, the second gear rotates simultaneously with the first gear. The assembly also comprises operable motive power to rotate the interconnected units. The method also includes the steps of boring an elongate canted opening in the ground at a selected angle from the ground, the opening extending from the surface of the ground to a subterranean space in which oil resides; inserting the oil extraction apparatus in the bore such that a portion of the first one of the units is positioned to receive oil from the subterranean space; and, operating the motive power to rotate the units such that oil from the subterranean space travels up the first and second ones of the units.

In still another embodiment of the invention, I provide an improved method to extract oil from the ground. The method comprises the step of providing an oil extraction apparatus comprising an elongate tubular assembly. The assembly comprises a plurality of sequential interconnected units. Each unit includes a hollow cylindrical conduit having a first end and a second end; a first gear mounted at the first end; a second gear mounted at the second end; a drive shaft connected to the first and second gears and extending through the conduit and intermediate the first and second gears; and, at least one helical blade attached to and extending about the drive shaft. The first gear on a first one of the sequential units engages the second gear on a second one of the units adjacent to the first one of the units to interconnect the first and second units such that when the drive shaft in the first one of the units rotates, the drive shaft in the first one of the units rotates simultaneously with the drive shaft in the second one of the units, and when the first gear rotates, the second gear rotates simultaneously with the first gear. The assembly also comprises operable motive power to rotate the interconnected units. The assembly also comprises an electrically conductive coil-magnet assembly operatively associated with a selected one of said plurality of units such that rotation of the selected one of the plurality of units inductively produces an electromotive force across the coil and produces eddy currents in at least one in a group consisting of the coil and the selected one of the plurality of units; such that the eddy currents generate heat in at least the selected one of the units; and, such that the electromotive force travels along at least a portion of the selected one of the units and generates heat in the selected one of the units. The method also includes the steps of boring an elongate canted opening in the ground at a selected angle from the ground, the opening extending from the surface of the ground to a subterranean space in which oil resides; inserting the oil extraction apparatus in the bore such that a portion of the first one of the units is positioned to receive oil from the subterranean space; and, operating the motive power to rotate the units such that oil from the subterranean space travels up the first and second ones of the units, an such that the electrically conductive coil-magnet assembly produces an electromotive force across the coil and generates heat in at least the selected one of the plurality of units.

Turning now to the drawings, which depict the presently preferred embodiments of the invention for the purpose of illustration thereof, and not by way of limitation of the invention, and in which like characters refer to corresponding elements throughout the several views, FIG. 1 illustrates one embodiment of the invention comprising oil extraction apparatus generally identified by reference character 10.

Oil extraction apparatus 10 includes units 11 and 12, pulley 25, and continuous belt 27 operated by a motor (not shown) to provide the motive power utilized to power apparatus 10.

Units 11 and 12 are identical in shape, dimension, and construction, although this need not be the case.

Unit 11 includes hollow cylindrical housing 13, drive shaft 15, a first helical blade 17 circumscribing and fixedly connected to shaft 15, and a second helical blade 18 circumscribing and fixedly connected to shaft 15.

Unit 12 includes hollow cylindrical housing 14, drive shaft 16, a first helical blade 19 circumscribing and fixedly connected to shaft 16, and a second helical blade 20 circumscribing and fixedly connected to shaft 16.

An internally threaded aperture 21, 22 can be formed in one end of a shaft 15, 16, respectively. An externally threaded nose 23, 24 can be formed at the other end of a shaft 15, 16, respectively. Each nose 23, 24 is shaped and dimensioned to turn into an aperture 21 or 22, or, to turn into an internally threaded aperture 26 formed in a pulley 25.

Units 11 and 12 are connected such that circular lip 68 of housing 13 contacts and is in registration with circular lip 69 of housing 14. One method of interconnecting shafts 15 and 16 is to turn nose 24 into internally threaded aperture 21.

A drive shaft 15 and blades 17, 18 can rotate inside a housing 13. Alternatively, blades 17 and 18 can be fixedly secured to housing 13 such that housing 13, shaft 15 and blades 17 and 18 rotate simultaneously. Further, a shaft 15 and one or more helical blades mounted on shaft 15 can be utilized without a housing 13. For sake of the following discussion concerning use of the apparatus of FIG. 1, it is assumed that the housing 13, 14 of each unit 11 and 12 is utilized and that blades 17, 18, 20, 21 and shafts 15 and 16 each turn freely inside their respective housing 13, 14.

As is shown in FIG. 1, one or more auxiliary units 70 can be interposed between and in alignment with units 11 and 12 to increase the length of the apparatus of FIG. 1. Unit 70 is identical in shape, dimension, and construction, to units 11 and 12, although this need not be the case. In addition, a conically shaped nose 71 can be attached to the lower end 70 of unit 12. Nose 71 preferably, but not necessarily, includes one or more peripheral helical blades (not shown) which extend around nose 71 in the same manner that blades 17 and 18 extend around shaft 15 and which can assist in carrying oil to blades 19 and 20. Nose 71 can provide ingress into a pool of oil and can rest against the bottom of a bore to assist in stabilizing apparatus 10 in position in the bore.

In use of the apparatus of FIG. 1, a sloped aperture is drilled in the earth to extend from the surface of the ground down to a desired subterranean pool of oil. The cant of the aperture from the horizontal is indicated by arrow C in FIG. 1 and typically is in the range of fifty to sixty degrees, although the slope can vary as desired. Vertically orienting units 11 and 12 (and therefore shafts 15 and 16) is not practical in the practice of the invention. Similarly, if angle C is in the range of one degree to twenty degrees or to thirty degrees, such is not practical because the blades 17, 18, 19, 20 will not effectively move oil or because the length of aperture required to reach a pool of oil is prohibitively long. Likewise, if angle C is in the range of seventy to ninety degrees, such is not practical because the blades 17 to 20 ordinarily do not effectively raise oil toward the surface of the ground when units 11 and 12 are canted at such a severe angle.

After the aperture is bored (or simultaneously while the aperture is bored), units 11 and 12 are mounted in the aperture so that the lower end 70A of the extraction apparatus 10 is sufficiently submerged in a pool of oil such that simultaneously rotating shafts 15, 16 and blades 17 to 20 causes oil to move upwardly first along blades 20 and 19 and then upwardly along blades 18 and 17. A motor (not visible in FIG. 1) is used to turn belt 27, which turns pulley 25 mounted on nose 23 and, as a result, turns shafts 15 and 16. The rotation of shafts 15 and 16 and blades 16 to 20 causes oil to move upwardly on blades 17 to 20 from the lower end 70A upwardly toward upper end 67, and out end 67 into a reservoir.

In an alternate embodiment of the invention, after a sloped aperture is formed in the ground, a hollow cylindrical oil well casing is inserted in the bore, after which the apparatus of FIG. 1 (or FIG. 2) is slidably inserted in the casing.

Figure 2:
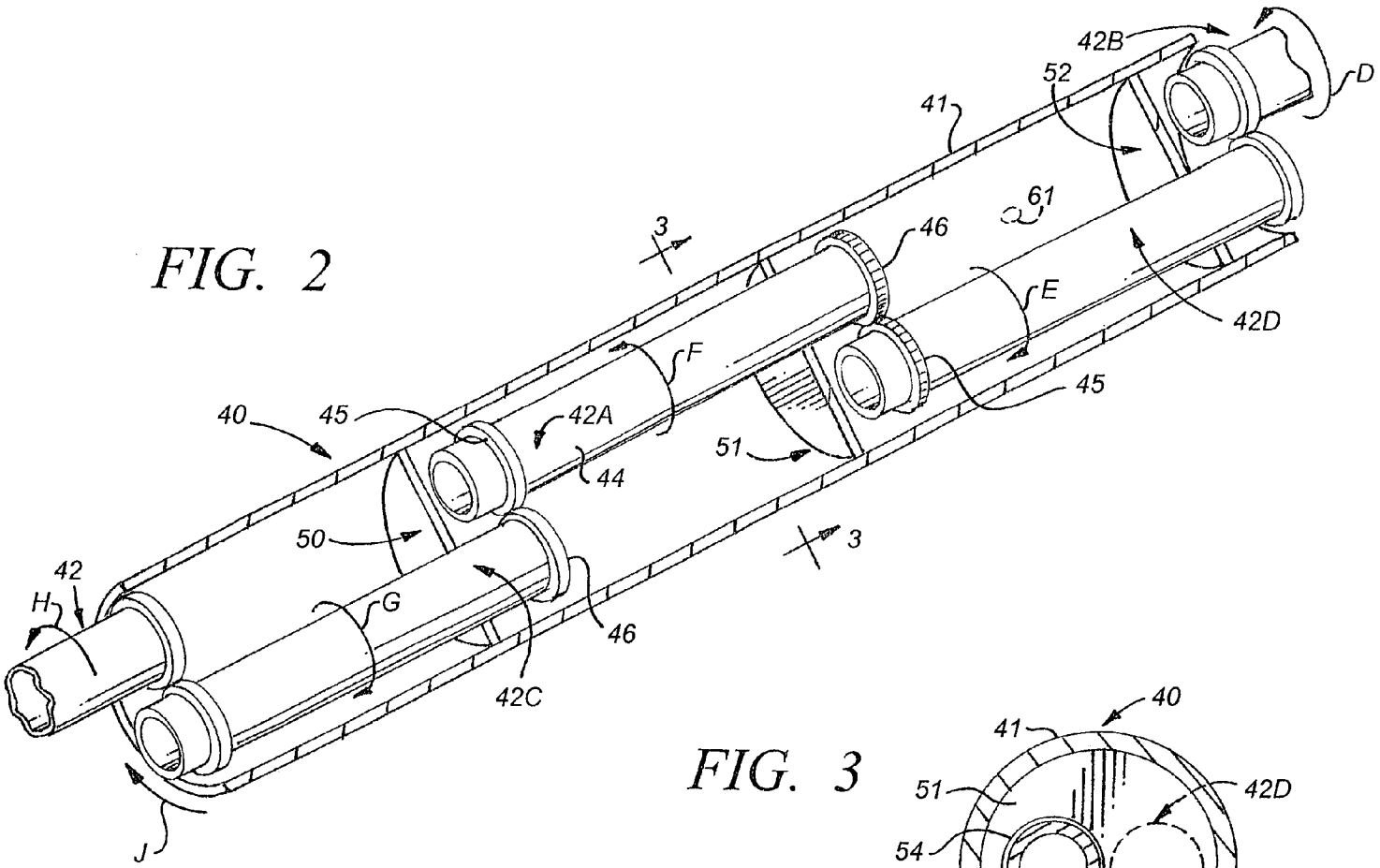
FIG. 2 is a perspective section view illustrating an alternate oil extraction apparatus constructed in accordance with the invention.
Figure 3:
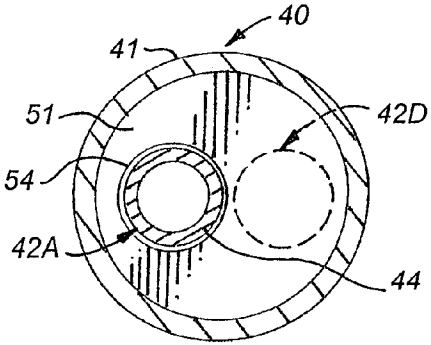
FIG. 3 is a section view of the apparatus of FIG. 2 taken along section line 3-3 thereof and illustrating additional construction details.
Figure 4:
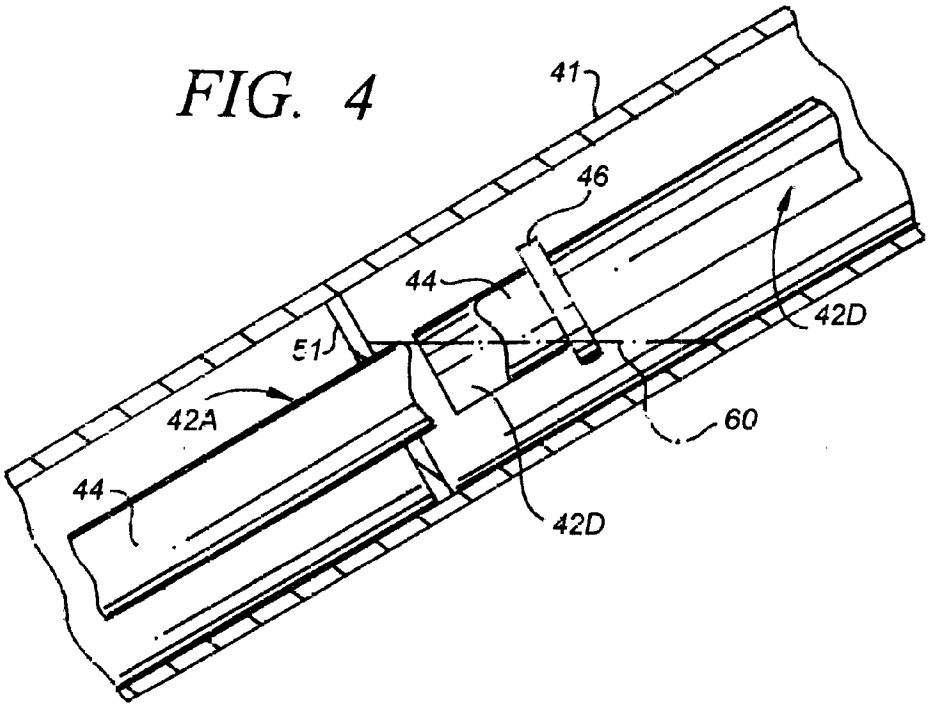
FIG. 4 is a side section view of the apparatus of FIG. 2 illustrating the mode of operation thereof.

An alternate embodiment of the invention is illustrated in FIGS. 2 to 4. The oil extraction apparatus of FIGS. 2 to 4 is generally indicated by reference character 40 and includes a hollow cylindrical housing 41 and a plurality of spaced-apart circular baffle plates 50 to 52 fixedly mounted inside housing 41.

Each of the staggered, interconnected, rotatable units 42, 42A, 42B, 42C, 42D is of equivalent shape, dimension, and construction, although this need not be the case. Each rotatable unit 42, 42A, 42B, 42C, 42D includes a hollow cylindrical housing 44 with first end with a toothed or other gear member (for example, the gear member might simply be a cylindrically shaped rubber sleeve extending around the first end) 46 fixedly attached thereto and with a second end with a toothed or other gear member 45 fixedly attached thereto.

Units 42, 42A, etc. are arranged along the interior of housing 41 in staggered, or offset fashion, in the manner shown in FIG. 2 so that each gear 46 on one end of a first unit 42, 42A, etc. is, except at the upper and lower ends of the apparatus 40, in contact with and rotatably interlocked with a gear 45 on the end of a second unit 42, 42A, etc. that is offset from the first unit. For example, in FIG. 2, the gear 46 on one end of unit 42A contacts and rotatably interlocks with the gear 45 on one end of unit 42D. Unit 42D is staggered or offset from unit 42A. The helical blade or blades mounted inside each housing 44 are fixedly attached to the housing such that the housing 44 and blade rotate simultaneously. Gears 45 and 46 are mounted and engage each other externally of the housings 44 of units 42A and 42C. Internally threaded apertures 21, 28 and externally threaded noses 27, 24 function as internal gears which are formed and engage and detachably interlock internally in the ends of a shaft 15, 29 when a nose 27, 24 is threaded into and interlocks with its associated aperture 21, 28. In an alternate embodiment of gearing configuration of the invention, apertures, or gears, 21 and 28 are each internally splined to receive and engage slidably noses, or gears, 27 and 24, respectively, which are each externally splined. Each nose 27, 24 slides into and detachably interlocks with its operatively associated internally splined aperture 21, 28, respectively. The elongate splines formed in apertures 21 and 28 and on noses 27, 24 are generally parallel to the co-linear longitudinal axes of shafts 15, 27, and 24. In another embodiment of the invention, the gearing arrangement comprises fitting a nose 27, 24 in an aperture 21, 28 and securing the nose 27, 24 in an aperture 21, 28 with a cotter pin or other fastener that extends at least partially through nose 27, 24 and/or aperture 21, 28. In an alternate embodiment of the invention, the ends of shafts 15 and 16 are welded or otherwise permanently secured to each other.

In FIG. 2 only one end of unit 42B is visible. The other end of unit 42B which is not shown in FIG. 2 is connected to a pulley and belt (or the desired motive power means) in a manner similar to the pulley 25 and belt 27 of FIG. 1. The belt is turned by a motor (not shown). The belt turns the pulley and unit 42B in the direction of arrow D (FIG. 1), which in turn rotates unit 42D in the direction of arrow E, which in turn rotates unit 42A in the direction of arrow F, which in turn rotates unit 42C in the direction of arrow G, which in turn rotates unit 42 in the direction of arrow H. The lower end of unit 42 is, in use, at least partially submersed in a pool of oil so that oil travels up rotating unit 42 and out the upper end of unit 42 into a pool formed behind a baffle plate (not visible in FIG. 2). The lower end of unit 42C is at least partially submersed in the pool. Oil in that pool then travels up rotating unit 42C and out the upper end of unit 42C to form a pool behind baffle plate 50. The lower end of unit 42A is at least partially submersed in the oil pool behind baffle plate 50. Oil from the pool behind baffle plate 50 travels up rotating unit 42A and out the upper end of unit 42A to form a pool of oil 60 (FIG. 4) behind baffle plate 51. As is depicted in FIG. 4, the lower end of unit 42D is at least partially submersed in pool 60. Oil from the pool 60 travels up rotating unit 42D and out the upper end of unit 42D to form a pool behind baffle plate 52. The lower end of unit 42B is at least partially submersed in the oil pool behind plate 52. Oil in the pool behind plate 52 travels up rotating unit 42B and out the upper end (not visible) of unit 42B into a reservoir or other desired containment or processing system.

In FIG. 2, the housing 41 and units 42, 42A, 42B, etc are viewed in an orientation in which housing 41 and units 42, 42A, 42B have been rotated about thirty degrees from their normal orientation in the direction of arrow J. When housing 41 and units 42, 42A, 42B, etc are in their normal presently orientation, the longitudinal axes of housing 41 and units 42, 42A, 42B each lay in a common flat plane that is parallel to the longitudinal axis of the aperture that is drilled in the ground and that is perpendicular to a vertical plane extending downwardly through the longitudinal axis of the aperture. The vertical plane is normal to the horizontally oriented upper surface of the ground. Such an orientation is presently preferred because it places the upper end of unit 42 and the lower end of unit 42 in the orientation illustrated in FIGS. 3 and 4. The orientation illustrated in FIGS. 3 and 4 facilitates the delivery of oil by unit 42A into pool 60, and facilitates immersing the lower end of member 42D sufficiently to permit the helical blade in member 42D to carry oil upwardly out of pool 60. FIG. 4 is a side view of a portion of the apparatus 40 of FIG. 2 when the apparatus 40 is in its preferred orientation in a bore in the ground. In FIG. 4, units 42A and 42D are in a "side-by-side" orientation and are not stacked one on top of the other. One or more openings 61 (FIG. 2) can be formed in housing 41 at desired locations therealong to relieve pressure that may builds up in housing 41. An opening 61 can house a one-way pressure relief valve which allows matter to flow outwardly from inside housing 41 and does not permit material to flow into housing 41 through the pressure relief valve. Or, such a pressure relief valve can only permit matter to flow into, and not out of, housing 41.

In one embodiment of the invention, one or more of the units 42,42A, 42B, etc. do not include a housing 44, but instead simply include a drive shaft and one or more helical blades mounted on the drive shafts. Gears or other means are mounted on the upper and lower ends of the drive shafts so that turning one of the drive shafts transmits motive power to and turns the remaining ones of the chain of staggered drive shafts. The drive shafts are offset from one another in the same manner that units 42, 42A, 42B, etc are offset from one another in FIG. 2. Similarly, in FIG. 1, housings 13 and 14 can be omitted and only the drive shafts and helical blades utilized.

Each unit 42, 42A, 42B, etc. presently preferably includes within housing 44 a drive shaft and at least one helical blade fixedly mounted on the drive shaft in the same manner as the drive shafts 15, 16 and blades 17 to 20 in FIG. 1. Each helical blades is fixedly secured to and rotate simultaneously with its associated housing 44. The drive shafts and helical blades are omitted from FIGS. 2 to 4 for sake of clarity.

In use of the apparatus of FIGS. 2 to 4, a sloped aperture is drilled in the earth to extend from the surface of the ground down to a desired pool of oil. The cant of the aperture from the horizontal typically is, as noted, in the range of fifty to sixty degrees, although the slope can vary as desired.

After the aperture is bored, the extraction apparatus 40 of FIG. 2 is mounted in the aperture so that the lower end of the apparatus 40 and of unit 42 is sufficiently submerged in a pool of oil such that simultaneously rotating units 42, 42A, 42B, etc causes oil to move upwardly through units 42, 42A, 42B, etc and from the oil pool behind one baffle plate to the oil pool behind the next higher baffle plate until oil reaches the upper end of apparatus 40 and of unit 42B. A motor (not visible in FIG. 1) is used to turn a belt or other mechanism that rotates unit 42B in the direction of arrow D, which then causes the remaining units 42, 42A, 42C, 42D to turn in the directions indicated by arrows H, F, G, and E, respectively. The rotation of the helical blades in units 42, 42A, 42B, etc. (simultaneously with the rotation of housings 44) causes oil to move upwardly through units 42, 42A, 42B, etc.

In FIGS. 2 to 4, the upper ends of units 42C, 42A, 42D each extend through an opening 54 formed in a baffle wall 50, 51, 52. If desired, a bushing can be mounted in opening 54 to receive rotatably the cylindrical end of a unit 42C, 42A. 42B. Unless the upper end of a unit 42, 42A, 42B, etc. is at the very bottom or very top of apparatus 40, it is rotatably supported by and mounted in a baffle plate. In FIG. 2 the lower ends of each unit normally are not mounted in a baffle plate but can, if desired, be so mounted, in which case appropriate openings would need to be formed in the lower end of the housing 44 to permit oil to flow into the interior of the housing and be transported upwardly by the helical blade in the housing.

Figure 5:
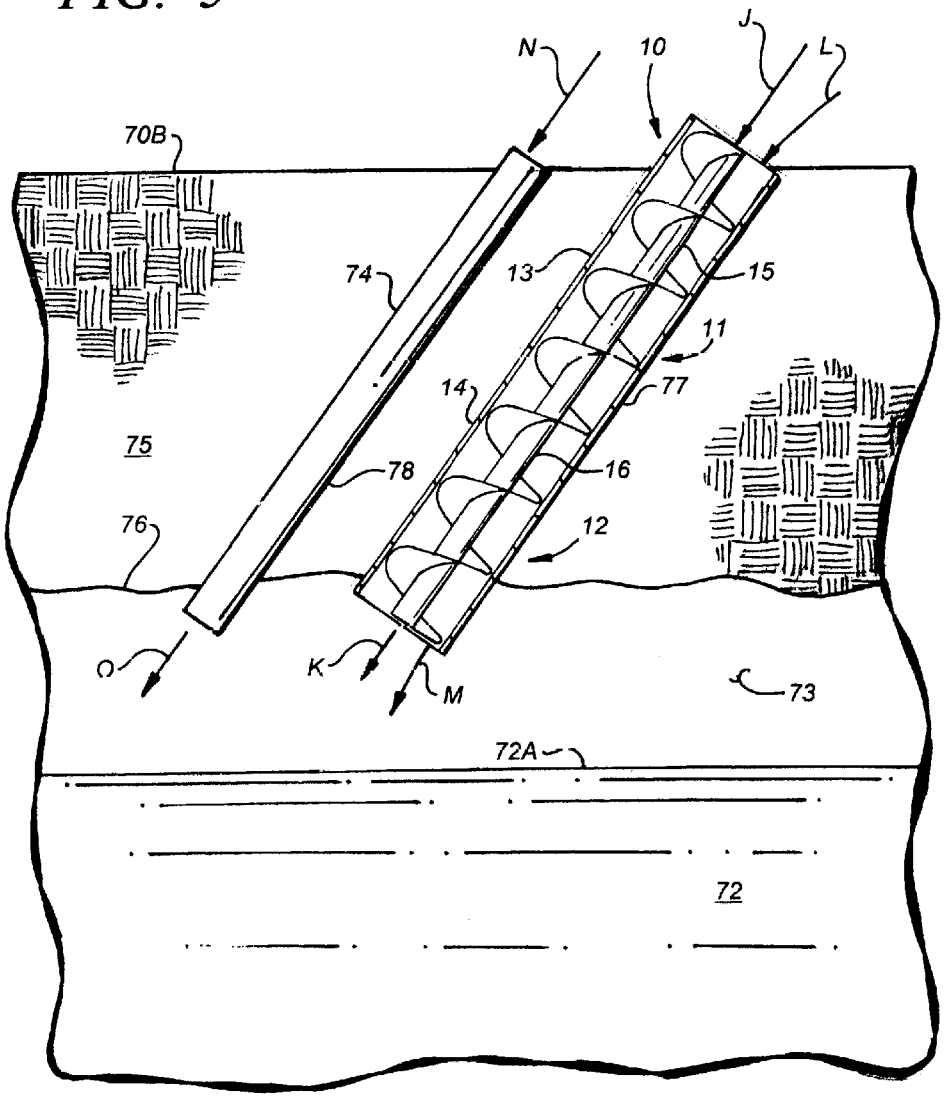
FIG. 5 is a side view of another embodiment of the invention illustrating the mode of operation thereof.

FIG. 5 illustrates a subterranean space 73 formed in the ground 75. Space 73 includes a roof or ceiling 76. Space 73 is partially filled with oil reservoir 72 or with oil bearing sands or other oil bearing material. Since oil reservoir 72 only partially fills subterranean space 73, there is a space extending from the top surface 72A of the oil reservoir 72 to the ceiling 76 of space 73, which space is filled with gas or another composition.

A first canted generally cylindrically shaped opening 77 is formed in ground 75 and extends from the upper surface 70B of ground 75 to the ceiling 76 of opening 73. Opening 77 is canted at an angle comparable to that earlier described herein. Apparatus 10 extends from surface 70B to ceiling 76. The lower end of apparatus 10 is, as shown in FIG. 5, positioned at ceiling 76. The upper end of apparatus 10 is located at the upper surface 70B of ground 75.

A second generally cylindrically shaped opening 78 can also, if desired, be formed in ground 75 and extend from upper surface 70B to the ceiling 76 of opening 73. Opening 78 can be canted or be vertically or horizontally oriented, as desired. A hollow cylindrical casing 74 extends from surface 70B to ceiling 76. Casing 74 can, if desired, extend any desired distance into oil reservoir 72.

In one embodiment of the invention utilized in conjunction with the apparatus 10 in FIG. 5, steam flooding is employed. Steam is injected into subterranean space 73, either above or directly into oil reservoir 72. Steam flooding utilizes two mechanisms to facilitate the recovery of oil with apparatus 10. The first mechanism heats the oil reservoir to a higher temperature and decreases the viscosity of the oil therein so the oil more readily flows into apparatus 10. The second mechanism is the upward physical displacement of oil toward roof 76 and the lower end of apparatus 10.

During steam flooding, the steam injected into space 73 can, when shafts 15 and 16 are hollow, be injected into and through shafts 15 and 16 in the manner indicated by arrows J and K. Alternatively, steam can, in the manner indicated by arrows L and M, be injected through housings 13 and 14 along a path intermediate shafts 15 and 16 and the inner surface of hollow cylindrical housings 13 and 14. Further, if desired, steam can, in the manner indicated by arrows N and O, be injected through casing 74 or through any other opening formed in ground 75.

In another embodiment of the invention utilized in conjunction with the apparatus 10 in FIG. 5, cyclic steam simulation is employed. Cyclic steam stimulation comprises the three phases of injection, soaking, and production. During the first phase, injection, sufficient steam is injected to increase the temperature of oil in reservoir 72 sufficiently for the oil to flow, or, at a minimum for the oil to be transported by apparatus 10 to the surface 70B of ground 75. During the second phase, soaking, the steam is allowed to "soak" for a selected period of time, typically no more than one to three days. During the third phase, production, oil is removed from the subterranean space 73 via apparatus 10. If the reservoir pressure has increased sufficiently, oil may flow upwardly through apparatus 10 without requiring that shafts 15 and 16 rotate. When necessary, shafts 15 and 16 are rotated to facilitate the lifting of oil upwardly to the surface 70B of ground 75.

During cyclic steam injection, the steam injected into space 73 can, when shafts 15 and 16 are hollow, be injected through shafts 15 and 16 in the manner indicated by arrows J and K. Alternatively, steam can, in the manner indicated by arrows L and M, be injected through housings 13 and 14 along a path intermediate shafts 15 and 16 and the inner surface of hollow cylindrical housings 13 and 14. Further, if desired, steam can, in the manner indicated by arrows N and O, be injected through casing 74 or any other opening formed in ground 75.

In a further embodiment of the invention utilized in conjunction with the apparatus 10 in FIG. 5, artificial lift is utilized. During artificial lift, air, steam, or another gas is injected into apparatus 10 to reduce the weight of the hydrostatic column. This reduces back pressure and facilitates allowing both the pressure in reservoir 73 and in subterranean space 73 to push oil upwardly through apparatus 10, and allowing apparatus 10, when shafts 15 and 16 are appropriately rotated, to lift oil upwardly toward surface 70. When artificial lift is utilized, apparatus 10 can be equipped with side pocket mandrels and gas lift injection valves. Alternatively, gas can be injected through hollow shafts 15 and 16 in the manner indicated by arrows J and K, or, can be injected into housings 13 and 14 in the manner indicated by arrows L and M. The distance, or depth, of gas injection into apparatus 10 can vary as desired. For example, it may be decided to inject gas into apparatus 10 to a depth from surface 70B equal to only one half the total length of apparatus 10, or equal to only one fourth the total length of apparatus 10, and so on.

In still another embodiment of the invention utilized in conjunction with the apparatus 10 in the system depicted in FIG. 5, in conjunction with the use of apparatus 10 as described in connection with FIG. 1, or in conjunction with the use of apparatus 40 as described in connection with FIGS. 2 to 4, superlubricity is employed to minimize and, if possible, substantially eliminate the generation of frictional forces which are generated between blades 17 to 20 and the inner surfaces of housings 13 and 14 during the rotation of shafts 15 and 16 and which act to prevent the rotation of shafts 15 and 16.

One form of superlubricity is termed structural lubricity. Structural lubricity produces incommensurate contact between a pair of crystalline surfaces when the surfaces contact and are rotated out of registry and slide over one another. Consequently, in this embodiment of the invention, the outer edges of blades 16 to 20 and the inner surfaces of housings 13 and 14 are constructed of crystalline materials which are, when possible, rotated out of registry with one another to facilitate the sliding of the outer edges of blades 16 to 20 over the inner surfaces of housings 13 and 14.

Another form of superlubricity can occur when a sharp tip slides over a flat surface. Although the outer edges of blades 16 to 20 and the inner surfaces of housings 13 and 14 are arcuate, and not flat, the movement of each point on the outer edge of a blade 16 to 20 over an inner surface of housing 13 and 14 may be comparable to the movement of a sharp tip over a flat surface. Consequently, producing blades 16 to 20 with a sharp outer edge may reduce the frictional forces between blades 16 to 20 and the inner surfaces of housing 13 to 14. As used herein, the outer edge of a blade 16 to 20 is sharp if it comes to a point in the manner of the edge of a knife. Knifes used by a chef to cut raw potatoes, carrots, etc. typically are quite sharp and sport a razor-like edge. In contrast, a dinner knife of the type used to butter bread and cut soft items such as cooked bean or potatoes, typically does not sport a razor-like edge, but instead has a more rounded, duller edge. Nonetheless, the edge of such a dinner knife is also considered to be sharp in accordance with the invention. In some instances, a somewhat rounded knife edge can also facilitate the sliding movement of the edge of a blade 16 to 20 over the inner surface of a cylindrically shaped housing. The appropriate degree of sharpness, whether it be a razor-like edge which can be found on a hunting knife or a duller edge of the type found on a butter knife or dinner knife, utilized on the outer edge of a blade 16 to 20 can be selected as desired. The natural lubrication provided by oil traveling through apparatus 10 will also significantly reduce frictional forces generated between the outer edges of blades 16 to 20 and the inner surfaces of housings 13 and 14.

Still another form of superlubricity is achieved by introducing vibrations in apparatus 10. Such vibrations can be introduced in the form of sound waves, can be introduced by repeatedly contacting apparatus with a hammer or other solid object, can be introducing by oscillating apparatus 10 or a portion thereof back and forth through short distances, or by any other desired manner.

Still a further form of superlubricity is achieved when the pressure in the subterranean opening is sufficient to force oil from reservoir 72 and at least partially up into apparatus 10 in FIG. 5. Such pressure generates a lift force which acts upwardly in a direction opposite that of arrow J and tends to support shafts 15, 16 and the helical blades thereon. Such lift function tends to offset the weight of shafts 15, 16 and the helical blades mounted thereon and to reduce friction produced when the weight of shafts 15, 16 and blades 16 to 20 presses downwardly against portions of the inner cylindrical surfaces of housings 13 and 14. One mechanism which can be employed to make use of such a lift force is to spring load the upper end of apparatus 10 so that while shafts 15 and 16 (and consequently blades 16 to 20) are being rotated, shafts 15 and 16 can, when shafts 15 and 16 and blades 16 to 20 are being lifted by oil flowing upwardly into apparatus 10, move a short distance upwardly and "float" in the upward flow of oil to minimize the frictional forces generated when portions of rotating blades 16 to 20 bear downwardly against portions of the inner surfaces of housings 13 and 14.

In another embodiment of the invention, shafts 15 and 16 and blades 16 and 20 are not being mechanically rotated but are instead permitted to free wheel. This is particularly the case in the event the pressure in reservoir 73 is sufficient to cause oil to flow upwardly through apparatus 10. As the oil follows a helical path up through apparatus 10, permitting shafts 15 and 16 and blades 16 to 20 to free wheel reduces, by permitting shafts 15 and 16 and blades 16 to 20 to rotate due to the flow of oil over the same, the frictional resistance generated by oil flowing over blades 16 to 20. The blades 16 to 20 rotate "with" and in the same direction as the flow of oil. In one embodiment of the invention, shafts 15 and 16 are permitted to free wheel by simply putting the motive power apparatus which normally rotates shafts 15 and 16 into neutral, much like the transmission of a car can be put into neutral. In another embodiment of the invention, shafts 15 and 16 are permitted to free wheel by completely disconnecting the motive power apparatus from apparatus 10.

The upward transportation to "ground zero" (i.e., to the surface) of subterranean oil can be impeded by low temperatures in the ground or at the surface, particularly in seasonal climates where winter weather produces temperatures which are below freezing.

In an alternate embodiment of the invention, energy associated with a magnetic field and with the mechanical rotational motion of a drive shaft 15, 16 is used to produce both heat and electricity. The electricity produced is utilized to produce power for a motor which produces motive power to rotate the drive shaft 15, 16; is used to power other electrical apparatus; or, is utilized to produce heat.

Figure 6:
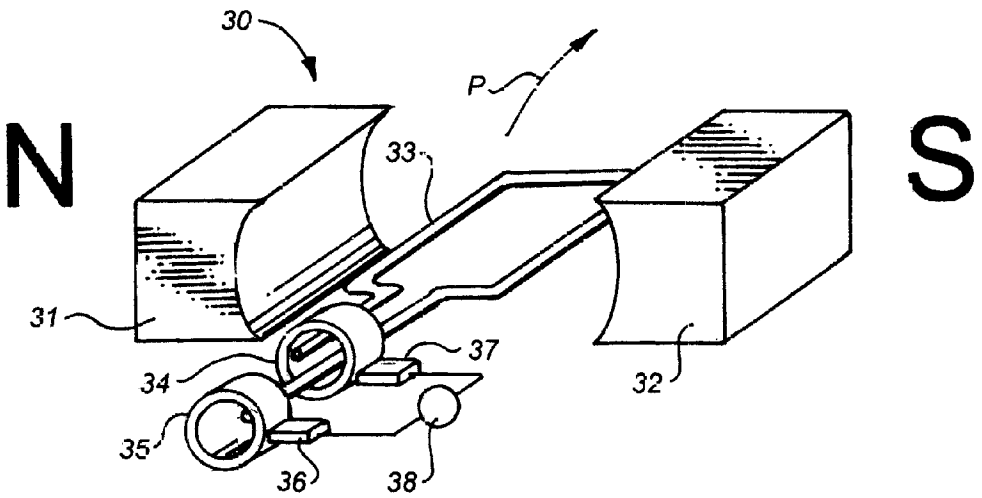
FIG. 6 is a perspective view illustrating components of an alternate embodiment of the invention.

An electromotive force is inductively produced across a electrical conductor when the conductor is exposed to a varying magnetic field, either by moving the conductor with respect to the magnetic field or by moving the magnetic field with respect to the conductor. This converts the mechanical energy of motion to electrical energy. Accordingly, when electrically conductive wire 33 in FIG. 6 is rotated through a magnetic field which is produced by a magnetic device 30 having a north pole 31 and a south pole 32, an electromotive force is inductively produced across conductor 33. The ends of conductor 33 contact slip rings 34 and 35. Carbon brushes are connected to a load 38.

Figure 7:
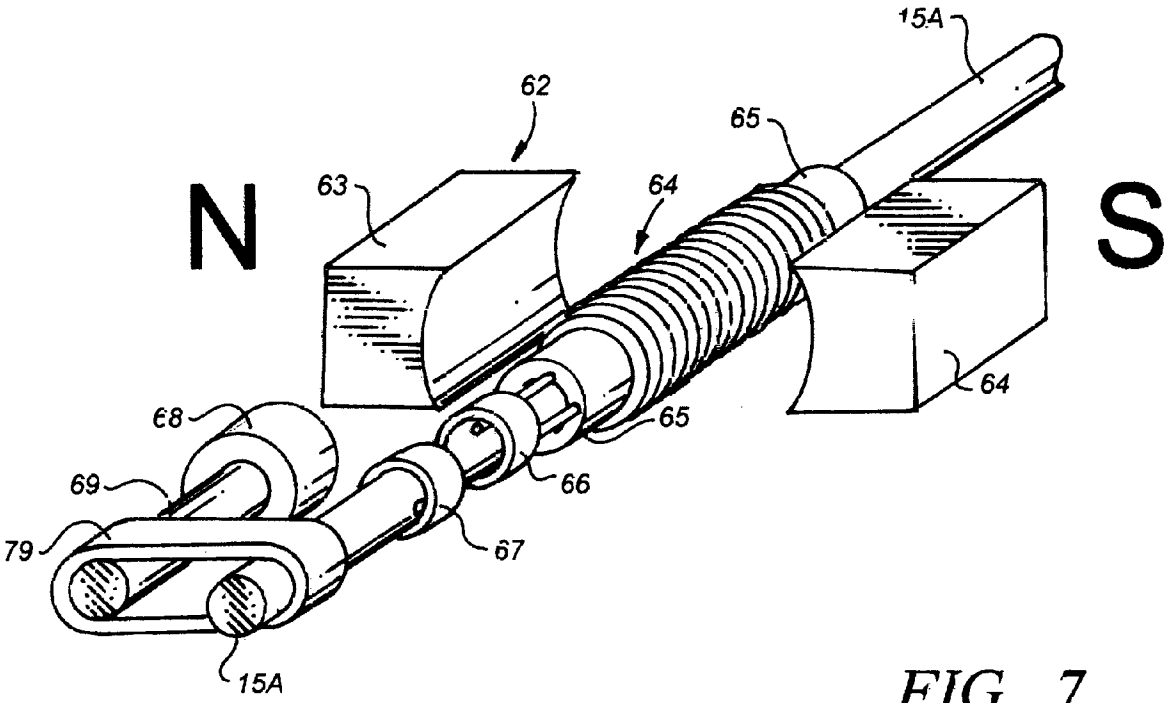
FIG. 7 is a perspective view illustrating components of another alternate embodiment of the invention.

In FIG. 7, electrically conductive coil 64 wraps around a hollow cylindrical core 65. Core 65 is fixedly mounted on shaft 15A. A helical blade is mounted on and circumscribes shaft 15A in the same manner that helical blade 17,18 circumscribes shaft 15 in FIG. 1. In use, shaft 15A extends into the ground in the same manner that shaft 15 extends into the ground. Consequently, the remaining portion of shaft 15A, which is not shown in FIG. 7, would extend upwardly toward the upper right corner of the sheet of paper of the drawing. The helical blade which is mounted on and circumscribes shaft 15A is mounted on this remaining portion of shaft 15A. If desired, core 65 can be eliminated and coil 64 can, if desired, be wrapped directly around shaft 15A.

The two ends of coil 64 each contact a different one of slip rings 66 and 67. Motor 68 turns shaft 69 and, accordingly, turns belt 79 to rotate shaft 15A. Rotating shaft 15A rotates coil 64 through a magnetic field which is produced by a fixed magnetic device 62 having a north pole 63 and a south pole 64. Carbon brush apparatus comparable to the carbon brush apparatus 36, 37 illustrated in FIG. 6 can be used to direct current through a load 38.

Figure 8:
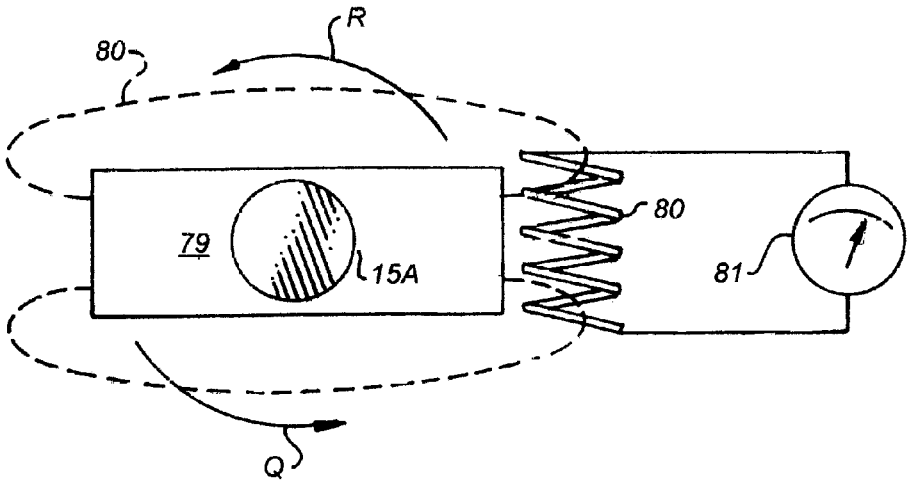
FIG. 8 is a side view illustrating components of a further alternate embodiment of the invention.

In FIG. 8, magnet 79 is fixedly mounted on shaft 15A. Rotating shaft 15A in the manner indicated by arrows Q and R simultaneously rotates magnet 79 such that the magnetic field 80 of magnet 79 periodically passes through coil 80 to produce an alternating current detected by load 81.

Figure 9:
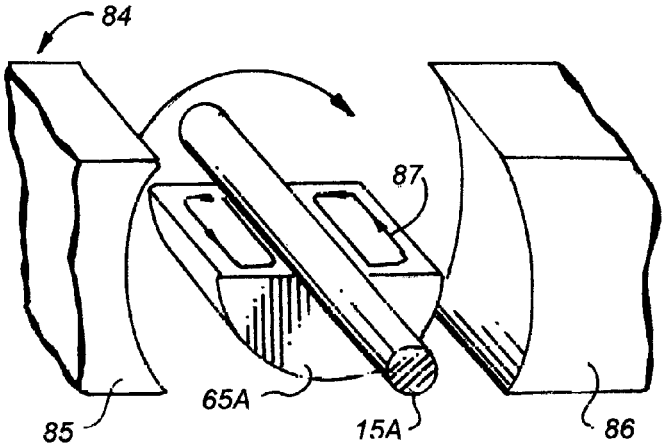
FIG. 9 is a perspective view illustrating eddy currents generated during utilization of an inductive embodiment of the invention; and, FIG. 10 is a perspective view illustrating components of an alternate embodiment of the invention.

When a solid metallic mass rotates in a magnetic field, eddy currents are produced because the outer portion of the mass passes through more lines of force that does the inner portion. As a result, the induced electromotive force is not uniform and eddy currents are set up between points of the largest and the least potential. Such eddy currents can consume a considerable amount of energy and, as a byproduct, produce a significant rise in temperature. In FIG. 9, a metallic core 65A is fixedly attached to and rotates simultaneously with shaft 15A. As the core rotates it passes through a magnetic field extending between the north pole 85 and south pole 86 of a magnet device 84. Eddy currents 87 are produced in core 65A while it rotates intermediate the north 85 and south 86 poles.

Figure 10:
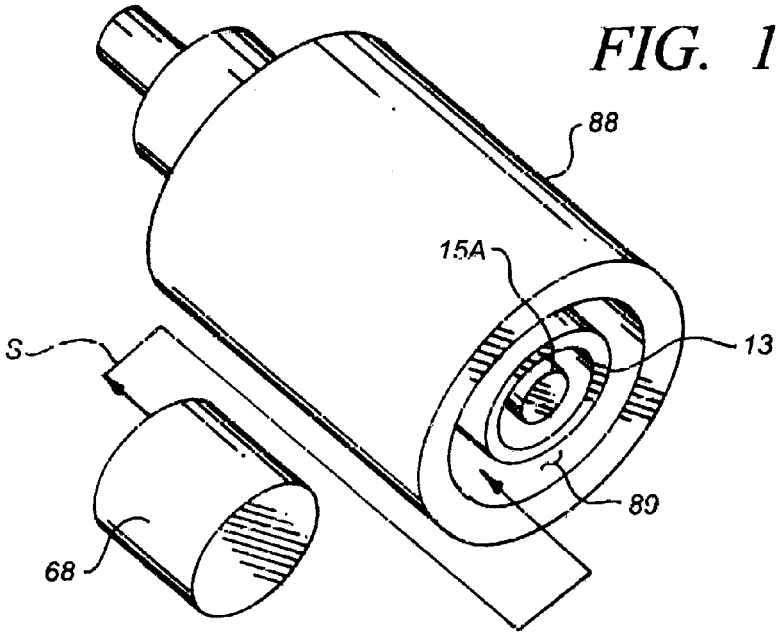

In FIG. 10, shaft 15A rotates inside a hollow housing. 13 (or 14 or 41, etc.). A helical blade 17, 18 (not visible in FIG. 10) is mounted on shaft 15A and extends through housing 13 with shaft 15A. Cylindrical housing 13 extends through hollow cylindrical sleeve 88. Heat produced by motor 68 during its operation is directed (with a fan, by convection, by radiation, or by other means) into the space 89 intermediate housing 13 and sleeve 88. The heat warms housing 13 and shaft 15A and helical blade 17, 18 inside housing 13.

In one preferred embodiment of the invention, the apparatus of FIG. 7 is utilized to produce alternating current. The apparatus produces eddy currents in core 65 and shaft 15A. Such eddy currents, while often undesirable in electric generators and other induction apparatus, are desirable in the practice of the invention because they produce heat. Both shaft 15A and core 65 are preferably constructed of electrically and thermally conductive metals. Heat produced by eddy currents is therefore transmitted along shaft 15A and functions to heat directly shaft 15A and a helical blade 17, 18 mounted on shaft 15A. Such heat production can be important in cold inclement weather, particularly in northerly geographic locations, because heat makes the oil less viscous and facilitates the removal of liquid oil from subterranean locations. In addition, alternating current produced by the apparatus of FIG. 7 can be directed along shaft 15A. Alternating current tends to travel along the surface of shaft 15A, which effectively increases the electrical resistance of shaft 15A and also tends to produce heat and to warm shaft 15A. The heat produced by eddy currents and by the travel of alternating current through shaft 15A, is viewed as essentially a free form of energy because shaft 15A must be rotated to allow helical blade 17, 18 to function to draw oil upwardly to the surface of the earth from a subterranean location. Positioning a magnetic field adjacent rotating shaft 15A allows electricity and heat to be produced. As would be appreciated by those of skill in the art, a variety of equipment configurations exist for producing inductively electricity by rotating or otherwise passing a coil or electrically conductive element through a fixed magnetic field, or by rotating or otherwise passing a magnet past a fixed electrically conductive coil. Any such configuration can be utilized in the practice of the invention as long as alternating current and eddy currents are produced and utilized to heat a shaft 15A and helical blades 17, 18 mounted on shaft 15A. Inductively produced current can also be used to help power motor 68 or other electrically operated equipment.

Shaft 15A, helical blades 17 and 18, coils 64, and cores 65 are preferably fabricated from electrically and thermally conductive materials, preferably metals. Thermal and conductivity coefficients are set forth below in Tables 1 and 2. The coefficient of electrical conductivity ρ of coil 64 or of another component in which current is to be inductively produced can vary as desired but presently is in the range of $1.0\times10^7$ (iron) to $6.3\times10^7$ (silver) at 20 degrees C., preferably in the range of $1.69\times10^7$ to $6.3\times10^7$ at 20 degrees C. Coil 64 is preferably completely or substantially fabricated from a metal or metal alloy.

TABLE 1

Resistivity and Conductivity at 20 Degrees C.

| Metal | Resistivity ρ(Ω · m) at 20 degrees C. | Conductivity σ (S/m) at 20 degrees C. |
|---|---|---|
| Silver | $1.59\times10^{-8}$ | $6.30\times10^7$ |
| Copper | $1.68\times10^{-8}$–8 | $5.96\times10^7$ |
| Gold | $2.44\times10^{-8}$–8 | $4.10\times10^7$ |
| Aluminum | $2.82\times10^{-8}$–8 | $3.5\times10^7$ |
| Tungsten | 5.60 × 10–8 | $1.79\times10^7$ |
| Zinc | 5.90 × 10–8 | $1.69\times10^7$ |
| Nickel | 6.99 × 10–8 | $1.43\times10^7$ |
| Lithium | 9.28 × 10–8 | $1.08\times10^7$ |
| Iron | 1.0 × 10–7 | $1.0\times10^7$ |
| Platinum | 1.06 × 10–7 | $9.43\times10^{-7}$ |
| Tin | 1.09 × 10–7 | $9.17\times10^6$ |
| Carbon steel | (1010) | $1.43\times10^{-7}$ |
| Lead | 2.2 × 10–7 | $4.55\times10^6$ |
| Titanium | 4.20 × 10–7 | $2.38\times10^6$ |
| Grain oriented electrical | 4.60 × 10–7 | $2.17\times10^6$ |

TABLE 1-continued

Resistivity and Conductivity at 20 Degrees C.

| Metal | Resistivity ρ(Ω · m) at 20 degrees C. | Conductivity σ (S/m) at 20 degrees C. |
|---|---|---|
| steel | | |
| Stainless steel | 6.9 × 10–7 | $2.17\times10^6$ |
| Mercury | 9.8 × 10–7 | $1.02\times10^6$ |
| Nichrome | 1.10 × 10–6 | $9.09\times10^5$ |
| Germanium | 4.6 × 10–1 | 2.17 |

The coefficient of thermal conductivity of a shaft 15A, which shaft may or may not include a core 65 mounted on the shaft, can vary as desired but presently preferably is in the range of 0.09 to 1.096 at eighteen or twenty degrees C. The coefficient of thermal conductivity of a coil 64 or of another component in which current is to be inductively produced can vary as desired but presently is in the range of 0.15 to 1.096, preferably in the range of 0.2 to 1.096 at least one of eighteen or twenty degrees C. Electrical and thermal coefficients of conductivity which exhibit significant thermal and electrical conductivity are typically associated with metals and metal alloys and are critical in the practice of the invention.

TABLE 2

Thermal Conductivity at 20 Degrees C.

| Metal | Coefficient of Thermal Conductivity, λ g.-cal./(sec.)(squ. Cm.)(° C./cm.) |
|---|---|
| Silver | 1.096 |
| Copper | 0.920 |
| Gold | 0.744 |
| Aluminum | 0.461 |
| Tungsten | 0.383 |
| Zinc | 0.2635 (@ 18° C.) |
| Nickel | 0.140 (@ 18° C.) |
| Lithium | 0.17 |
| Iron | 0.1436 (@ 18° C.) (With o.1% C + 0.1% Mn + 0.2% Si) |
| Platinum | 0.167 |
| Tin | 0.1528 |
| Carbon steel | 0.1085 (@ 18° C.) (99% Fe + 1% C) |
| Lead | 0.0827 (@ 18° C.) |
| Mercury | 0.0248 |

In the practice of the invention, the motor 68, coil 64, magnet device 62 and other components illustrated in FIG. 7 are normally be located above ground for easy access, but may be partially or completely enclosed by a building structure. For purposes of this application, if the motor 68, coil 64 and magnet device 62 are located in an excavation made or existing (for example, a cave) in the ground, such is considered as being above ground.

Having described the invention and presently preferred embodiments and the best modes thereof in such terms as to enable one of skill in the art to make and use the invention,

I claim:

1. A method to extract oil from the ground, comprising the steps of (a) providing an oil extraction apparatus comprising an elongate tubular assembly, said assembly comprising (i) a plurality of sequential interconnected units each including a hollow cylindrical conduit having a first end, a second end, a first gear mounted at said first end, a second gear mounted at said second end, a drive shaft connected to said first and second gears and extending through said conduit and intermediate said first and second gears, at least one helical blade attached to and extending about said drive shaft, said first gear on a first one of said sequential units engaging said second gear on a second one of said units adjacent to said first one of said units to interconnect said first and second units such that when said drive shaft in said first one of said units rotates, said drive shaft in said first one of said units rotates simultaneously with said drive shaft in said second one of said units, and when said first gear rotates, said second gear rotates simultaneously with said first gear, (ii) operable motive power to rotate said interconnected units, (iii) an electrically conductive coil-magnet assembly operatively associated with a selected one of said plurality of units such that rotation of said selected one of said plurality of units inductively produces an electromotive force across said coil and produces eddy currents in at least one in a group consisting of said coil and said selected one of said plurality of units, the eddy currents generate heat in at least said selected one of said plurality of units, said electromotive force travels along at least a portion of said selected one of said plurality of units and generates heat in said selected one of said plurality of units;

(b) boring an elongate canted opening in the ground at a selected angle from the ground, said opening extending from the surface of the ground to a subterranean space in which oil resides;

(c) inserting said oil extraction apparatus in the bore such that a portion of said first one of said units is positioned to receive oil from said subterranean space; and, (d) operating said motive power to rotate said units such that (i) oil from said subterranean space travels up said first and second ones of said units, and (ii) said electrically conductive coil-magnet assembly produces an electromotive force across said coil and generates heat in at least said selected one of said plurality of units.

2. The method of claim 1 in which (e) said subterranean space includes a ceiling;

(f) in step (c) said oil extraction apparatus includes a lower end positioned adjacent said ceiling;

(g) oil in said subterranean space resides in a reservoir having a surface spaced beneath said ceiling; and, (h) intermediate steps (c) and (d) steam is injected in said subterranean space to displace oil in said reservoir upwardly toward said ceiling.

* * * * *